United States Patent [19]

Lau et al.

[11] 4,105,164

[45] Aug. 8, 1978

[54] TRIGGER LOCK MECHANISM FOR SPRAY GUNS

[75] Inventors: George W. Lau, Blue Island; Edward J. Bujnowski, Chicago, both of Ill.

[73] Assignee: Binks Manufacturing Company, Franklin Park, Ill.

[21] Appl. No.: 745,294

[22] Filed: Nov. 26, 1976

[51] Int. Cl.[2] ..... B05B 7/02

[52] U.S. Cl. ..... 239/526

[58] Field of Search ..... 239/526–528, 239/583; 251/93, 101–109, 114, 116

[56] References Cited

U.S. PATENT DOCUMENTS

| | | | |
|---|---|---|---|
| 1,101,464 | 6/1914 | McDonald | 251/109 X |
| 2,690,321 | 9/1954 | Luna et al. | 251/116 |
| 3,330,527 | 7/1967 | Nurkiewicz | 251/114 |
| 3,380,705 | 4/1968 | Enssle | 239/526 X |
| 3,780,953 | 12/1973 | Malec | 239/526 |
| 3,836,082 | 9/1974 | Krohn | 239/526 |

*Primary Examiner*—John J. Love

*Attorney, Agent, or Firm*—Gary, Juettner & Pyle

[57] ABSTRACT

A trigger lock mechanism for hand held spray guns is characterized by an arm normally positioned to block operation of a trigger of the gun, but movable by an operator to release the trigger for operation. The trigger lock is particularly useful with so-called airless paint spray guns, and the arm is generally U-shaped and secured at its free ends to opposite sides of the trigger. The closed end of the arm extends around the rear of the gun whereat a housing normally blocks rearward movement thereof, and therethrough the trigger, when the trigger is in its unoperated position. By deliberate action an operator may move the closed end of the arm out of blocking engagement with the housing to release the trigger for movement to its operated position. Then, with return of the trigger to its unoperated position, the arm automatically returns to its position blocking operation of the trigger. The trigger lock mechanism thus prevents accidental or unintentional discharge of a paint spray from the gun.

10 Claims, 4 Drawing Figures

76
20
50
24
38
34
46
54
52
66
98
70
4
77
106
108
96
40
88
56
60
64
4
120
84
86
62
44
22
36
30
32
28

24
106
112
98
114
116
102
100
108
86
84
104
22

77
120

81a
50
48
81
100
98
108
3
3
34
90
46
96
77
120
84

TRIGGER LOCK MECHANISM FOR SPRAY GUNS

BACKGROUND OF THE INVENTION

The present invention relates to trigger lock mechanisms for spray guns.

In the use of hand held spray guns and the like, the guns are occasionally accidentally discharged as by being dropped on a trigger thereof or perhaps through the direct but unintentional action of a careless operator. This can result in nearby articles being ruined by a spray discharged therefrom or, much worse, injury to the operator himself, as by having the spray enter his eyes.

With air type paint spray guns, paint discharged from a nozzle is introduced into a stream of compressed air, typically at 50–90 p.s.i., for being atomized and shaped into a fan-like spray. With such guns, the primary hazard presented to a careless operator is accidental direction of the spray into his eyes.

With so-called airless paint spray guns, paint is supplied to the gun under extremely high pressure, typically 2000–3000 p.s.i., which is sufficient to atomize the paint upon discharge from a specially designed nozzle orifice. Upon operation of the gun, this high pressure is presented at and for a short distance in front of the orifice to a point whereat the paint is atomized and loses its force. Not only might accidental discharge of this type gun direct a spray of paint into the eyes of the operator, but with such high pressure available paint can be injected directly into skin positioned at and in close proximity with the orifice. It is therefore desirable, both with air and airless type spray guns, to provide a mechanism which prevents nondeliberate or accidental operation of the guns.

OBJECTS OF THE INVENTION

An object of the present invention is to provide a trigger lock mechanism for hand held spray guns which prevents unintentional or accidental operation of the guns.

Another object of the invention is to provide such a mechanism which releases the trigger for operation only upon deliberate action by an operator.

A further object of the invention is to provide such a trigger lock mechanism which automatically relocks the trigger against operation following each return thereof to its unoperated position.

An additional object of the invention is to provide such a trigger lock mechanism of inexpensive and simple construction, and which readily may be operated when the gun is held by an operator in a spraying position.

SUMMARY OF THE INVENTION

In accordance with the present invention, a mechanism for blocking unintentional movement of a trigger of a spray gun to its operated position includes a generally rigid member secured to the trigger and extending to a position remote therefrom. Means are provided at the remote position for normally blocking movement of the member, and therethrough the trigger, the member being movable by deliberate action of an operator of the gun to clear the blocking means to free the trigger for movement to its operated position.

In the disclosed embodiment the member is elongated, is rotatably secured at a first end thereof to the trigger, and extends at a second end to the position remote from the trigger. The blocking means includes a housing positioned adjacent the second end of the member, which normally blocks movement of the second end of the member, and therethrough the trigger, when the trigger is in its unoperated position. The member is manually rotatable about the trigger by deliberate operator action to move the second end thereof from blocking engagement with the housing, whereby the trigger is freed for movement to its operated position.

Preferably, the housing has a wall positioned to blockingly engage the second end of the member when the trigger is unoperated and the member is in a first rotational orientation with respect thereto, and an opening for receiving therein the second end upon operation of the trigger when the member is in a second rotational orientation with respect thereto. A spring urges the member toward and to the first rotational orientation when the trigger is unoperated to prevent operation of the trigger except by deliberate operator movement of the member, against the urging of the spring, to the second rotational orientation.

The foregoing and other objects, advantages and features of the invention will become apparent upon consideration of the following detailed description when taken in conjunction with the accompanying drawings.

DETAILED DESCRIPTION

Figure 1:
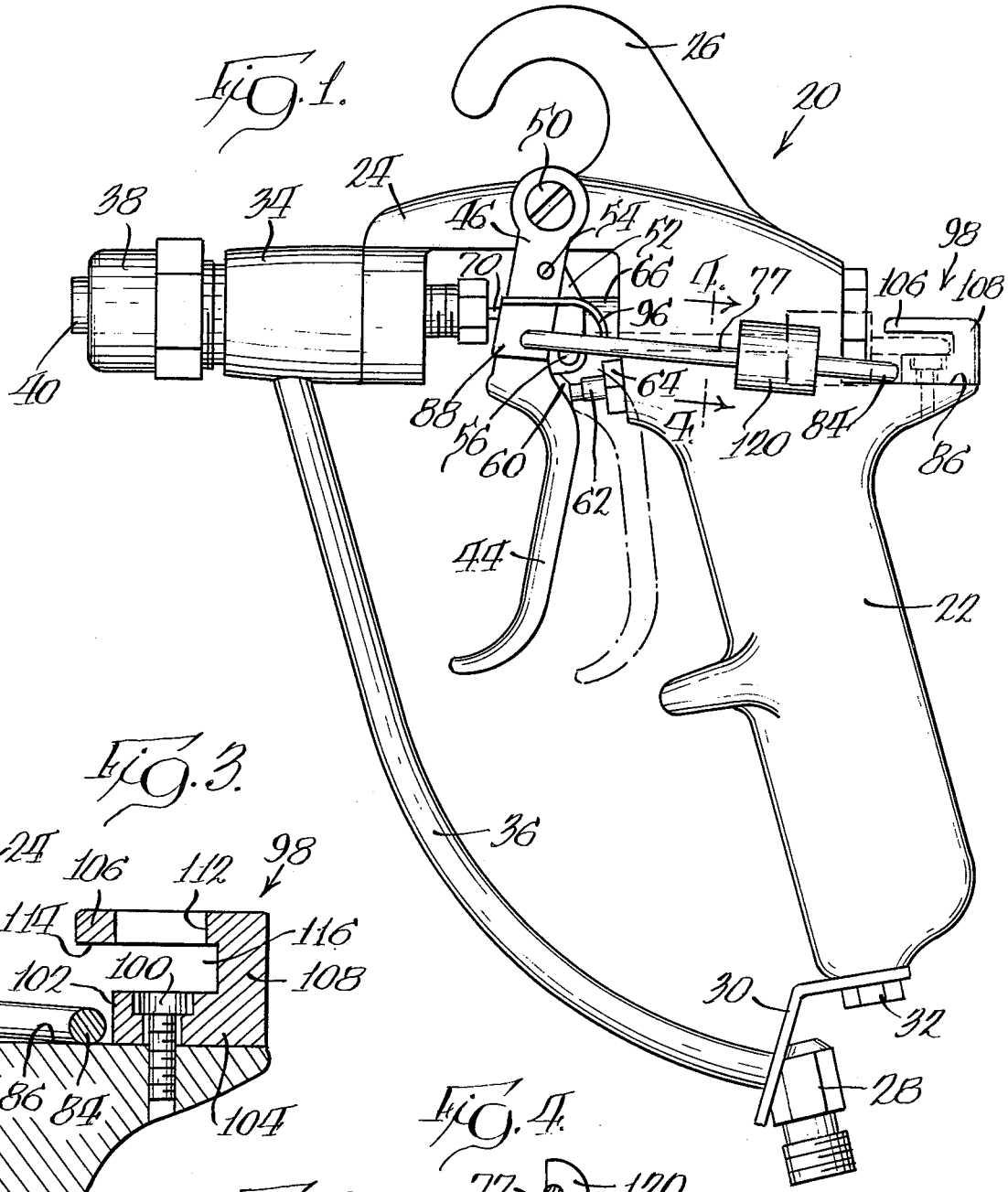
FIG. 1 is an elevation view of a conventional spray gun having a trigger lock mechanism embodying the principles of the present invention, showing the connection of the mechanism with the trigger of the gun.

Referring to FIG. 1, there is shown an airless paint spray gun, indicated generally at 20, having a trigger lock mechanism embodying the principles of the present invention. The gun is of generally conventional design, and includes a handle 22 extending upwardly to a barrel portion 24 having a hook 26 formed in an upper surface thereof to facilitate hanging storage of the gun. An inlet fitting 28, for connecting with a supply of paint (not shown) under pressure, is secured to one end of a bracket 30, the other end of which is fastened to the bottom of the handle as by a bolt 32. A paint receiving chamber 34 at a forward end of the barrel receives paint from the fitting 28 through a conduit 36, and a nozzle housing 38 having a nozzle 40 with an orifice therein is secured to the forward end of the chamber 34.

Figure 2:
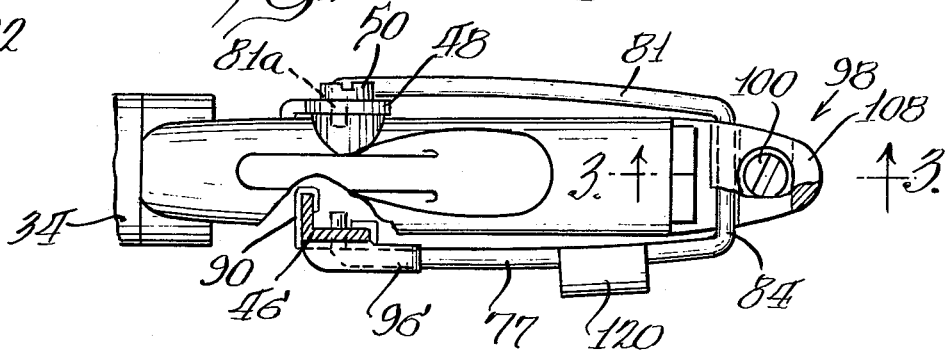
FIG. 2 is a fragmentary, top plan view of the rearward portion of the gun of FIG. 1, illustrating the general configuration of the mechanism.

Referring also to FIG. 2, means for manually operating the spray gun includes a trigger having an operator grippable handle 44 with upwardly extending bifurcated sections 46 and 48 which are hinged to opposite sides of the barrel by screws 50. A pair of arms 52 (only one being shown) are rotatably linked with and between the sections 46 and 48 by a pin 54, the lower ends of the arms being joined by a pin 56. A screw having a head 60 and a shaft 62 is threadably adjusted in the barrel to engage the head with the pin 56, and is then locked in position with a nut 64.

A plunger 66 is spring loaded in the rear portion of the barrel toward the forward end thereof, and engages the arms 52. This urges the arms counterclockwise, in the drawing as shown, about the pin 56 to urge the trigger, through the action of the pin 54, clockwise about the screws 50 to a normally unoperated or relaxed position toward the front of the gun. A valve control rod 70 is fastened to the plunger and extends through a guide 72 to a valve (not shown) in the paint receiving chamber 34 to control a flow of paint from the chamber to the nozzle orifice. The arrangement is such that when the trigger is in its unoperated position away from the handle, the valve is closed and the gun is off. When the trigger is moved by an operator of the gun to its operated position toward the handle, as shown in phantom lines, the plunger and the valve control rod are moved toward the rear of the gun, the valve is opened, and the gun is operated to discharge paint in a spray therefrom. The valve opening controls the flow rate of paint from the gun, and is directly related to the amount of movement of the trigger toward the handle.

In use of the gun, upon movement of the trigger toward the handle paint under high hydrostatic pressure, typically 2000 to 3000 p.s.i., is valved through the chamber 34 for discharge in a spray from the nozzle orifice. The high pressure is substantially present in the spray at and for a short distance in front of the orifice to a point whereat atomization occurs and the spray loses its force. Between the orifice and the point of atomization the paint can forcibly penetrate the skin of a careless operator positioned thereat. Also, with either airless or air guns, unintentional operation of the gun by a careless operator may result in a spray of paint being directed into his eyes. It is therefore desirable to provide a trigger lock mechanism for the guns which prevents their operation except in response to a deliberate and intentional action by an operator thereof.

In accordance with a preferred embodiment of the present invention, such a trigger lock mechanism includes a relatively rigid, generally U-shaped arm having side legs 77 and 81 joined at a closed end of the arm by an end leg 84. L-shaped ends **77*a* and 81*a* of the legs are rotatably received in passages in respective trigger sections 46 and 48, with the side legs extending rearward therefrom on opposite sides of the barrel and with the end leg passing around the end of the barrel and over a shelf 86**.

In the operation of the mechanism, the arm is normally urged clockwise (in the drawings as shown) about the trigger to urge the end leg 84 toward the shelf 86. This is conveniently accomplished with a spring clip 88 positioned around the trigger section 46. The clip includes an L-shaped body portion 90 having flanges formed at opposite ends thereof to define a semi-open enclosure into which the section 46 is received. A passage formed through the body portion 90 aligns with the passage through the section 46, and receives therethrough the end **77*a* of the side leg 77. A spring arm 96** formed integrally with the body portion extends into engagement with the side leg to urge the leg, and therefore the entire arm, in the clockwise direction about the trigger.

In the disclosed construction, rearward movement of the trigger to its operated position is constrained to rearward movement of the end leg 84 of the arm along the shelf 86. Therefore, movement of the trigger to operate the gun may be controlled by controlling rearward movement of the end leg.

Figure 3:
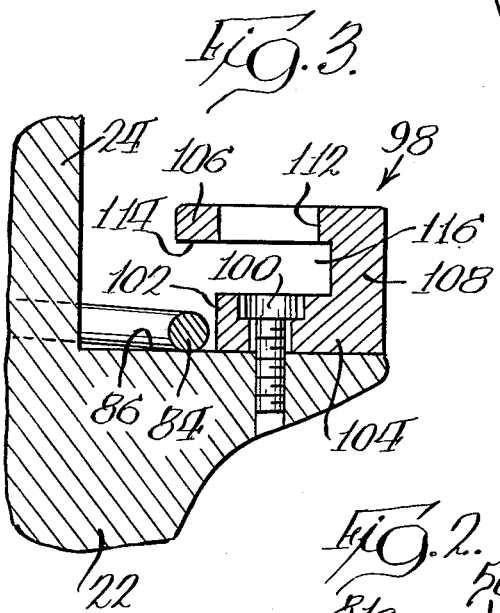
FIG. 3 is taken substantially along the lines of 3—3 of FIG. 2, and shows a housing for selectively blocking movement of an arm at a rearward portion of the trigger lock mechanism.
Figure 4:
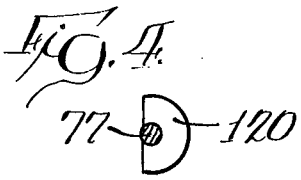
FIG. 4 is taken substantially along the lines 4—4 of FIG. 1, and illustrates a knob on the arm which is engagable by an operator of the gun to move the arm to a position out of blocking engagement with the housing to release the trigger for movement to its operated position.

To control rearward movement of the end leg, as best shown in FIG. 3 a detent housing 98 is secured by a bolt 100 on the shelf 86. The housing is generally U-shaped, and has a vertical blocking edge 102, at a free end of a lower leg 104, positioned rearward of the end leg 84 when the trigger is in the forward, gun off position. The housing also has an upper leg 106 and an end leg 108 joining the rearward ends of the legs 104 and 106, with a passage 112 through the upper leg providing access to the bolt 100. The upper leg extends further toward the front of the gun than the lower leg 104 by an amount sufficient to engage, with a lower surface 114 thereof, the end leg 84 when the arm is rotated counterclockwise against the urging of the spring clip. A passage or opening 116, of sufficient width to accommodate the end leg 84, is formed between the lower and the upper legs.

In the use of the arm and the detent housing to prevent unintentional or accidental operation of the gun, with the trigger in its forward, unoperated position, the end leg 84 is at a first position and is urged against the shelf 86 immediately forward of the blocking edge 102. Under this condition, the arm is in a first rotational orientation with respect to the trigger and any attempt, accidental or otherwith, to operate the trigger is prevented by engagement of the end leg 84 with the blocking edge 102. Accordingly, should the gun be dropped onto its trigger, or the trigger be unintentionally squeezed, the gun will not operate.

To release the trigger for movement to its operated position toward the handle requires a deliberate action by an operator of the gun. The arm must be rotated against the urging of the spring clip to a second rotational orientation with respect to the trigger whereat the end leg 84 clears the blocking edge 102 and is at a second position in alignment with the opening 116. Under this condition, movement of the trigger toward the handle is enabled by entry of the end leg 84 into the opening 116, with the surface 114 of the leg 106 preventing movement of the end leg past the opening and guiding the end leg therein upon operation of the trigger. To aid an operator in moving the arm to the second rotational orientation, a thumb pad or knob 120 is secured to the leg 77 above the handle 22 for being pushed upward with the thumb of an operator while the operator is gripping the handle.

With the end leg 84 of the arm within the opening 116, movement of the trigger between positions fully opening or closing the valve in the chamber 34 is permitted without the end leg passing over the blocking edge 102 of the leg 104. This allows an operator to precisely control, or feather, the spray from the gun between off and on conditions without the need for constantly moving the arm to position the end leg in the opening. During this time operation of the gun is under the conscious control of the operator, and there is no need to protect the operator against accidental operation thereof. Later, when the trigger is released and returns to its forward position, the end leg 84 clears the blocking edge 102 and is again urged by the spring clip against the shelf 86 whereat it is again positioned to be blocked by the edge 102, whereby the trigger is automatically relocked against accidental operation.

The invention thus provides a trigger lock mechanism, a simple construction, for spray guns. The mechanism effectively locks the trigger of a gun against unintentional operation, is releasable by deliberate action of an operator to allow use of the gun over its full operating range, and automatically returns to a trigger locking position upon release of the trigger by the operator. In this manner, operation of the gun is prevented except by conscious action of an operator.

While one embodiment of the invention has been described in detail, it is understood that other modifications and various embodiments thereof may be devised by one skilled in the art without departing from the spirit and the scope of the invention, as defined by the appended claims.

What is claimed is:

1. In a trigger lock mechanism for a spray gun, for controllably blocking movement of a trigger thereof from a gun off to a gun on position, an arm secured at a first end thereof to said trigger and extending at a second and opposite end thereof to a position remote from said trigger, said second end being movable between first and second positions when said trigger is in said gun off position and normally being in said first position, and being constrained for movement generally in a first direction with said trigger upon movement thereof toward said gun on position, and means for blocking movement of said second end in said first direction when said end is in said first position, said second end when in said second position being movable in said first direction past said blocking means, whereby said trigger is blocked by said arm against movement to said gun on position when said second end is in said first position, and is movable to said gun on position when said second end is in said second position.

2. In a trigger lock mechanism for a spray gun for controllably blocking a trigger thereof against movement to a gun operated position, an elongated member rotatably secured at a first end thereof to said trigger and extending at a second end thereof to a position remote from said trigger, said member being rotatable about said trigger between first and second rotational orientations and normally being in said first rotational orientation, and said second end being constrained for movement generally in a first direction with said trigger upon movement thereof toward said gun operated position, and means for blocking movement of said second end in said first direction when said member is in said first rotational orientation, said second end being movable in said first direction past said blocking means when said member is in said second rotational orientation, whereby said trigger is blocked by said member against movement to said gun operated position when said member is in said first rotational orientation, and is movable to said gun operated position when said member is in said second rotational orientation.

3. In a mechanism as set forth in claim 2, said blocking means including a housing positioned adjacent said second end of said member and having a wall positioned to blockingly engage said second end upon movement of said trigger toward said gun operated position when said member is in said first rotational orientation, and having an opening positioned to receive said second end upon movement of said trigger toward said gun operated position when said member is in said second rotational orientation.

4. In a mechanism as set forth in claim 3, said housing having a portion for engaging said second end when said member is in said second rotational orientation and for guiding said second end into said opening when said trigger is moved toward said gun operated position.

5. In a mechanism as set forth in claim 4, means for urging said member toward said first rotational orientation, and means for engaging said second end when said member is in said first rotational orientation to prevent rotation of said member therepast.

6. In a mechanism for controlling the movement of a trigger of a paint spray gun of a type having a barrel with a forward paint spray discharge end, a handle at a rearward end of said barrel, and a trigger forward of said handle and normally urged away from said handle to a gun off position and movable by an operator of said gun to a gun on position toward said handle, a generally U-shaped member having a pair of side legs rotatably secured at free ends thereof to opposite sides of said trigger and extending along opposite sides of said barrel toward a rearward end thereof, and having an end leg extending around a rearward portion of said barrel and joining said side legs, said member being constrained for movement with said trigger in a first direction when said trigger is moved toward said handle and in a second and opposite direction when said trigger is moved away from said handle, and being rotatable about said trigger to move said end leg between first and second positions when said trigger is in said gun off position, and means for blocking movement of said end leg in said first direction when said end leg is in said first position to block movement of said trigger to said gun on position, said end leg being movable in said first direction past said blocking means when said end leg is in said second position to release said trigger for movement to said gun on position.

7. In a mechanism as set forth in claim 6, said end leg being at said first position when said member is in a first rotational orientation with respect to said gun, and at said second position when said member is in a second rotational orientation with respect to said gun, including means for urging said member in a direction of rotation to urge said end leg in a direction from said second position toward said first position, and a shelf extending from said rearward portion of said barrel for engaging said end leg at said first position to block movement of said end leg therepast by said urging means when said trigger is in said gun off position.

8. In a mechanism as set forth in claim 7, said blocking means including a generally U-shaped housing having a pair of side portions joined at ends thereof to form an opening therebetween of sufficient width to receive said end leg, said housing being positioned on said shelf with said opening toward said forward end of said barrel and with a free end of one of said side portions positioned adjacent to and rearward of said first position for blocking movement of said end leg in said first direction when said member is in said first rotational orientation, thereby blocking movement of said trigger to said gun on position, said other side portion extending at a free end thereof beyond said free end of said one side portion and having a surface toward said one side portion for engaging said end leg when said member is in said second rotational orientation and for guiding said end leg in said first direction and into said opening upon movement of said trigger to said gun on position, said urging means urging said end leg in said opening against said one side portion, and moving said end leg to said first position upon movement thereof beyond said free end of said one side portion with movement of said trigger to said gun off position.

9. In a mechanism as set forth in claim 8, further including a knob secured along at least one of said side legs of said U-shaped member for being pushed by an operator of said gun to facilitate rotational movement of said member against said urging means from said first to said second rotational orientation to release said trigger for movement to said gun on position.

10. In a mechanism as set forth in claim 9, wherein said urging means including a spring clip secured between said trigger and one of said member side legs for urging said side leg in a direction to rotate said member from said second to said first rotational orientation.

* * * * *